United States Patent [19]

Vigander

[11] 4,188,157

[45] Feb. 12, 1980

[54] MARINE STRUCTURE

[75] Inventor: Kjell Vigander, Jar, Norway

[73] Assignee: A/S Høyer-Ellefsen, Oslo, Norway

[21] Appl. No.: 885,974

[22] Filed: Mar. 13, 1978

[30] Foreign Application Priority Data

Mar. 15, 1977 [GB] United Kingdom ..... 10897/77

[51] Int. Cl.[2] ..... E02B 17/00; F17C 1/12

[52] U.S. Cl. ..... 405/210; 62/45; 405/207

[58] Field of Search ..... 61/101; 62/45; 114/256, 114/257; 175/8, 9; 405/195, 210, 207

[56] References Cited

U.S. PATENT DOCUMENTS

| | | | |
|---|---|---|---|
| 3,798,919 | 3/1974 | Hershner | 61/101 X |
| 3,828,565 | 8/1974 | McCabe | 61/101 X |
| 3,913,335 | 10/1975 | Heien | 405/210 |
| 3,938,343 | 2/1976 | Lamy | 405/195 X |
| 3,990,254 | 11/1976 | Mo | 61/101 |

*Primary Examiner*—David H. Corbin

*Attorney, Agent, or Firm*—Larson, Taylor & Hinds

[57] ABSTRACT

An offshore structure is provided for handling cryogenic fluids such as liquefied natural gas. The structure comprises a lower section of concrete and an upper section which projects up from the lower section above the sea level to support a deck superstructure. The lower section is formed of a plurality of cells and at least one of the cells houses an insulated tank for the storage of low temperature fluids. The tank or tanks are completely submerged when in operation and are rigidly supported by the associated cell. Each tank comprises a primary and secondary barrier with insulation associated therewith and the tank(s) communicates with the deck superstructure through an access tunnel system.

8 Claims, 12 Drawing Figures

MARINE STRUCTURE

The present invention relates to an offshore terminal for the loading, storing, production and/or gasification of natural liquefied gas. The terminal is preferably of a type which is intended to project up above the sea level when installed on the offshore site.

Present developments in the offshore oil and gas industry have proven that drilling and production of subsequeous oil and gas will increase significantly in the near future and will be extended to sites further from shore and at remote corners of the world. The production of fluid minerals from these sites creates many new problems, not the least of which is that of storing a produced fluid until it can be transported elsewhere. As the sites for the production of subaqueous mineral deposits move further from shore and to larger depths, the expenses involved in laying product pipelines on the sea bed from the offshore production units to shore will increase considerably. The present developments trend to partially or fully submerged structures, serving as storage units at an offshore production site. These structures are preferably of the type which is designed to be towed out to a desired location where they are submerged and placed on the sea bed or partly submerged to a semi-submerged position. The structure comprises therefore one or more cells which served as both ballast and/or storage compartments.

As the exploration of hydrocarbons extends further from shore into deeper water, the marine exploration structures will be subjected to more severe environmental forces and conditions than ever before encountered.

Further, the oil and gas exploration activities have reached offshore areas with large shipping traffic, resulting in increased risks of collision between a ship and an offshore structure. Therefore, an offshore structure being as safe as possible is required.

Only in recent years has it become economically possible to transport natural gas across the ocean for delivery to an appropriate market if the natural gas is liquefied. A large number of insulated tankers capable of transporting liquefied gas have therefore been constructed for this particular purpose. These tankers ply or travel between the remote production areas and terminals ashore close to the domestic and industrial market. Due to the risks of serious accidents in heavy populated areas, the trend is to move the receiving terminal of liquefied gas from shore to offshore areas in order to reduce the risks of serious accidents as much as possible.

It has been proposed to provide an oil production platform with tanks to accumulate liquefied gas for delivery to tankers or barges which ply between production platforms and the shore facilities. It has further been proposed to use either a semi-submersible structure or a gravity structure as production platform. From U.S. Pat. No. 3,507,453 a semi-submersible vessel for production of oil is known. The vessel includes a concrete hull having oil storage chambers and buoyancy compartments. Upstanding stabilizing columns are mounted on the hull on opposite sides of the pitch and roll axis of the vessel, one or more of which supports a working platform in spaced relation above the hull. At the site, the storage chamber is ballasted with sea water to submerge the hull and proportions of the stabilizing columns. Oil from the production site is pumped into the storage chamber to displace the water from the chamber. For this reason the vessel is equipped with a pipe arrangement so as to obtain communication between the different storage and ballast tanks and the oil inlet and the oil discharge outlet.

From U.S. Pat. No. 3,486,343 a drilling platform is disclosed, which platform is adapted to be floated to and sunk at an offshore location. The platform includes pontoons at the base for floating it to an offshore location and for engaging the ocean floor when the platform is sunk.

U.S. Pat. No. 3,766,583 discloses a portable offshore terminal for liquefied natural gas in which a cryogenic storage tank for the liquefied gas is mounted on a compartmented concrete base having sufficient buoyancy to float the tank. The base extends laterally beyond the wall of the storage tank and supports a barrier wall surrounding and in spaced relation from the storage tank. Bulkheads extending from the wall of the storage tank to the barrier wall divide the annular space between those walls into a plurality of ballast compartments provided with suitable means for varying the amount of water in these compartments to control the buoyancy of the terminal. The roof of the storage tank serves as a foundation or base for a gas liquefaction or regasification plant.

The terminal according to the present invention is preferably made of concrete. It should be noted, however, that the terminal alternatively may be made of steel. The terminal is preferable of the type comprising a fully submerged lower section with an upper structure projecting up from the lower section and up above the sea level, when in operational position. The terminal may, however, be of any other suitable form or type, for example a semi-submersible structure.

According to the present invention the terminal comprises a lower section formed by a plurality of cells, an upper section projecting up from the lower section, the upper section being formed by elongating the wall(s) of one or more of the cells in the lower section, and a deck superstructure supported above the sea level by the upper section. At least one of the cells arranged on the base houses a storage tank intended for storage of liquefied natural gas. The storage tank preferably comprises an inner and outer shell structure. The inner shell structure, which serves as the primary barrier is surrounded at least at the sides and bottoms by insulation, the insulation being arranged in the space between the two shell structures. Both shells may be of concrete. If required, a liner may be arranged on the internal wall of the inner shell structure, or the entire inner shell structure may be replaced by a steel membrane or a liner. A pipe arrangement, enabling communication with the interior of the storage tank and in the space between the two shell structures on each side of the insulation is installed.

The cells containing the storage tanks communicate with the surrounding sea water through a pipe arrangement or openings, thereby allowing the sea water to circulate around the storage tanks and keep a constant water temperature in the space between each cell and tank. The circulation is preferably maintained by a convective water flow due to the heat flow into the storage cells.

Preferably, the cells housing the storage tanks are terminated at such a height that these cells are completely submerged at a safe distance below the sea level when the terminal is installed in the operational position.

Each storage tank is at its lower or upper end supported by a foundation cylinder. These foundation cylinders communicate with the extended cell(s) forming the superstructure or with a utility cylinder arranged inside the extended cell(s) through access tunnels. Hence, it is possible to have atmospheric conditions in both the access tunnels and the foundation cylinders. All piping to and from the storage tanks are preferable arranged inside said tunnels, thereby simplifying the maintenance operations.

To ensure that any pressure build-up between the insulation and the concrete shell is relieved, vertical slots are made in the concrete wall surface(s) adjacent to the insulation. The slots are designed so as to converge at the top and the bottom of the storage tank, the converging points being in communication with evacuation pipes. Any pressure build-up which may occur due to minor leaks of gas or sea water may thus be relieved. These slots and the pipe arrangement may also be used to detect any gas leakage.

The shape of the cells and the storage tanks are preferably cylindrical. It should be noted, however, that the present invention is not limited to such shape. The cells and the storage tank may for example have a square, rectangular or polygonal cross section area.

Be varying the number of cells and the number of elongated shafts in the upper section, almost any configuration of gravity and floating structures can be achieved. It should be appreciated that according to the present invention, the liquefied natural gas storage tanks will always be shielded by by a structural cell and hence do not form a structural part of the terminal itself. Further, since the storage tanks preferably are completely submerged when the terminal is in operational position, the storage tanks will be subjected to a low and more or less constant environmental temperature with a corresponding low boil-off rate. In addition, subsea storage compartments may be obtained so as to minimize the danger of collision. Still further, it should be appreciated that the concrete structure itself also can withstand heavy impacts from dropped objects.

The overall design concept for this reinforced and post tensioned concrete structure leads mainly to compressive stresses in the various critical sections, which, of course, is highly desireable in any concrete structure. As for other gravity type structures, sufficient safety against overturning and sliding is achieved by the structures submerged weight, and in addition, by a special foundation design when at rest on the sea-bed.

The configuration of the structure is quite flexible and can be tailored to meet various functional requirements, environmental criteria and other parameters related to a specific site.

The storage system provides from a safety point of view several advantages, such as:

- Subsea storage that minimizes the danger of ship collision.
- The caisson, which is structurally isolated from the storage tanks, provides an excellent external protection of the LNG storage system.
- Environmental loads such as seismic, waves and wind are not imposed onto the storage tanks, but are sustained by the structure.
- Thermal loads from the cryogenic bulk are not imposed on the structure.

Complete access to the entire storage system is provided for inspection purposes of the exterior face of the concrete tanks as well as the interior containment system.

Regasification equipment such as the vaporizers and cryogenic piping are located and protected inside the tower. The tower is for safety reasons constructed to form a double wall that is interconnected to create a composite cross section. The equipment is designed for an average vaporizing capacity of one billion standard cubic feet per day (scfd) with a 100-percent peak production capability.

Other facilities for accomodation, utilities, power generation, operation and control are installed as modules on the deck frame outside the concrete tower and thereby protected from the cryogenic process equipment.

A safe system for direct transfer of LNG from the tankers is integrated in the Condeep concept.

The present invention will now be described by way of examples referring to the accompanying drawings, wherein.

Figure 1:
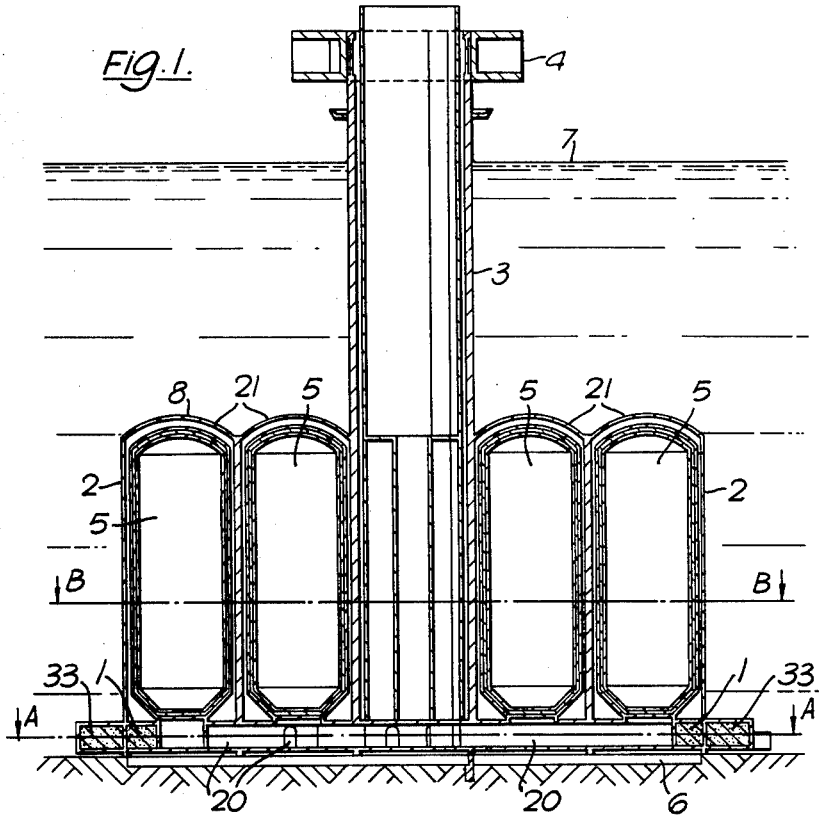
FIG. 1 shows schematically a vertical section through a monotower gravity structure where the lower section consists of nineteen cells, i.e. one tower and eighteen storage cells.

FIG. 1 shows schematically a vertical section through a gravity structure of the monotower type. The terminal consists of a lower section comprising a cellular base 1 and a plurality of cells 2 arranged on the base, the cells 2 forming an integral unit with the base 1. The terminal consists further of an upper section or shaft 3, which projects up from the base 1 and up above the sea level. The shaft 3 is formed by elongating the wall(s) of one or more of the cells 2 in the lower section. A deck superstructure 4 is supported above the sea level 7 by the shaft 3. The cells 2 in the lower section house storage tanks 5 intended for storage of liquefied natural gas. At the lower end, the terminal is equipped with skirts 6 forming an integral unit with the base and being intended to penetrate the sea bed to support the terminal. The lower section shown on FIG. 1 is composed of nineteen cells. One of these cells, namely the center cell, extends upwardly to form the shaft 3. At least some of the remaining cells may be equipped with insulated tanks 5 for storage of liquefied natural gas.

Each storage tank 5 comprises a primary barrier 11, insulation 12 with secondary barrier and a supporting shell structure of concrete. The primary barrier 11 may be formed as a steel membrane or a liner as shown on FIG. 12, and/or a concrete shell structure as shown on FIG. 4.

Figure 4:
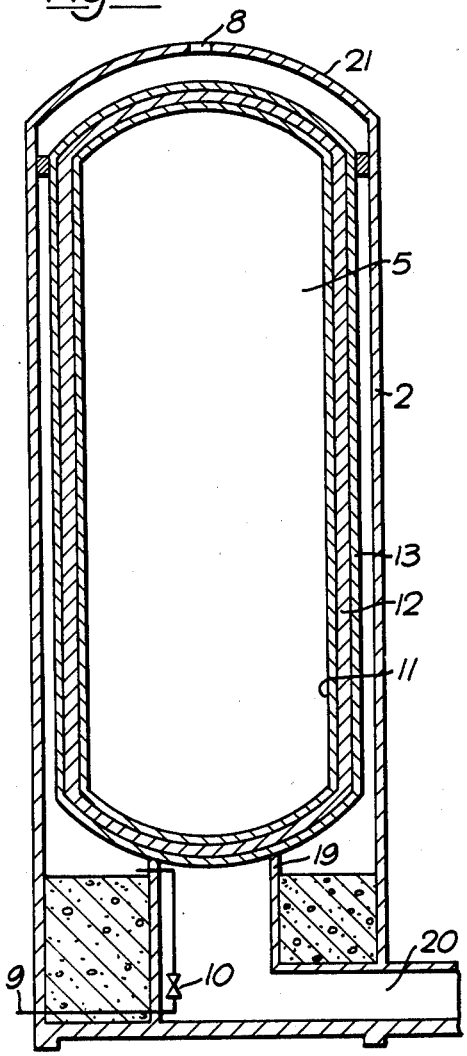
FIG. 4 shows a vertical section of one of the structural cells housing a storage tank for liquefied natural gas.
Figure 5:
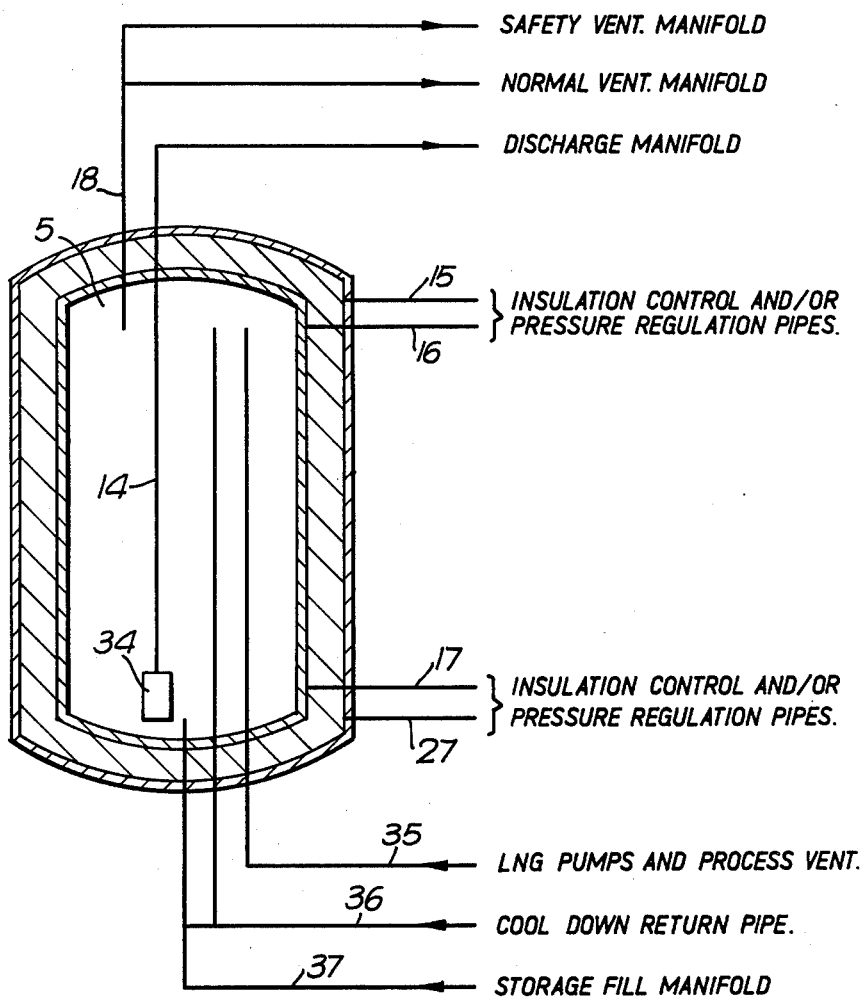
FIG. 5 shows a vertical section of one of the storage tanks, showing the sandwich construction, the foundation cylinder and access tunnel. A preferred piping arrangement is also shown schematically.

The supporting shell 13 (see FIG. 4), is supported by a cylindrical foundation 19 inside the cell 2, as shown on FIGS. 1, 4 and 5. Each foundation cylinder 19 communicates with the shaft 3 through an access tunnel 20, which may be air filled and subjected to atmospheric conditions. All piping to and from the storage tanks 5 is preferably arranged inside said tunnel 20, making the maintenance easier.

The cells 2 have openings 8 at the upper domes 21 and pipe outlets 9, 10 in the bottom part as can also be seen on FIG. 4. Due to heat flow into the storage cell, a convective water flow will keep a constant water temperature (5°–8° in the North Sea) in the spacing between the cells 2 and the storage tank 5.

Figure 2:
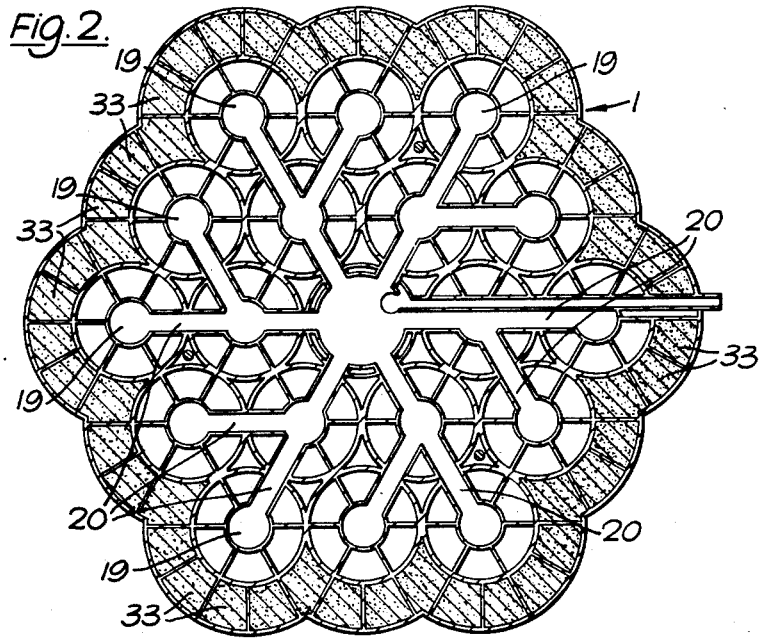
FIG. 2 shows a horizontal section along the line A—A on FIG. 1, showing the access tunnel system.
Figure 3:
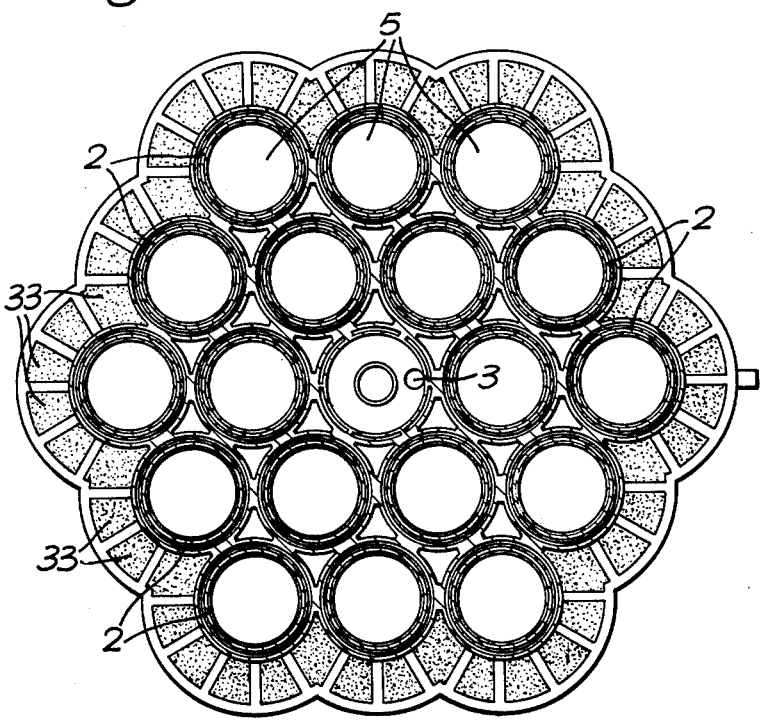
FIG. 3 shows a horizontal section along the line B—B on FIG. 1, showing the utility cylinder and storage cells.

FIG. 2 shows a horizontal section along the lines A—A on FIG. 1, showing the access tunnel system. FIG. 3 shows a horizontal section along the lines B—B on FIG. 1, showing the shaft 3, the cells 2 and the storage tanks 5.

FIG. 4 schematically shows a vertical section through one of the cells 2, housing a storage tank 5 for liquefied natural gas. As shown, the cell 2 freely communicates with the surrounding sea through a hole 8 in each top dome 21 and through a pipe outlet 9, 10 for water at the lower end. The water flow through the space between the cell 2 and the storage tank 5 is governed by the temperature difference. The storage tank 5 will be built up in a sandwich system. The tank 5 comprises a primary barrier 11, insulation 12 and a secondary barrier associated with a supporting shell structure 13. The supporting shell structure 13 is designed to withstand the appearing water pressure while the primary barrier 11 and the insulation 12 are designed to take the weight of the liquid and to shield against the low temperature where a primary barrier of concrete is used.

FIG. 5 shows schematically a vertical section of one of the storage tanks 5 showing schematically a preferred pipe arrangement. As normally done in LNG carrier, the LNG booster pump 34 will be placed inside the tank 5, with access to the storage cell from the top. The discharge pipe 14 from the individual storage tanks terminates in a discharge manifold which leads to the high pressure LNG pumps (not shown). The main storage fill line 37 ends in the bottom of the tank, but the line 36 makes the injection of LNG possible from the top of the tank. (See below). Here, a vent line 18 is divided into two branches; one safety vent line that terminates in a vent stack above deck, and a normal vent line used for pressure control in the tank. LNG pumps and other process equipment can have another vent line 35, which terminates at the top of the tank.

When a storage tank is emptied, and the LNG transfer and loading systems are not in use, a small amount of LNG will be circulated by small jockey pumps, keeping the system cooled down for immediate use.

Upon returning to the empty tanks, the LNG will then be sprayed into the tanks through a pipe 36.

When access to the storage cells is from below, the LNG booster pumps will be placed outside the tanks. In this case, line 14 is omitted and the booster pumps take suction from the main fill line 57.

The piping system comprises further, evacuation, insulation control and/or pressure regulation pipes 15, 16 17 and 27. These pipes are connected to a gas leakage detector (not shown) and are intended to evacuate gas or water from a possible minor leak.

The piping system is designed to:

1. control the tank pressure and liquid gas flow in or out of the tanks;
2. detect leakage and control the pressure on both sides of the insulation;
3. control the temperature in the storage cell; i.e. to maintain the cryogenic temperature even with an empty tank, so as to minimize the temperature stresses.

Figure 6:
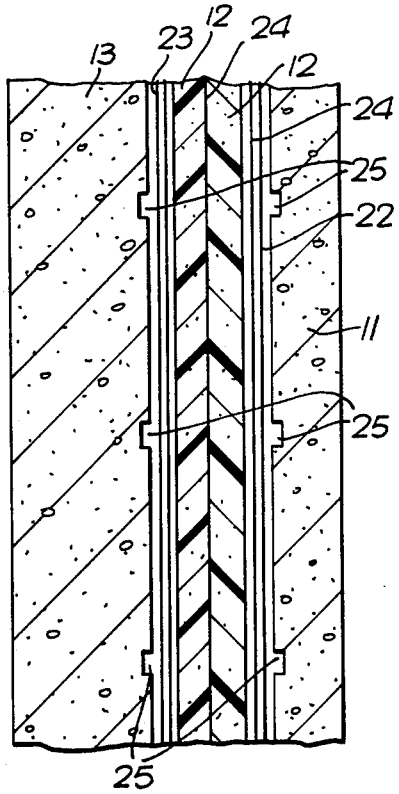
FIG. 6 shows in principle a horizontal section of a storage tank, giving details of an example of embodiment of the insulation with an inner concrete cell as a primary barrier.

FIG. 6 principally shows a section through one wall of the tank 5. As previously mentioned, each tank 5 comprises a primary barrier 11, for example of concrete, or a metal tank or membrane. In this case, the insulation is built up of a stainless steel membrane 22, insulation 12, a stainless steel membrane 23, and a supporting shell structure 13 of concrete. The insulation 12 may consist of two layers of polystyrene, the thickness of which totals approximately 22–25 cm. Between two layers and on the cold side of the insulation, there will be a fiberglass reinforcement 24, welded to the insulation 12. The insulation 12 will be protected from moisture by stainless steel covers 22, 23, for example made of sheets having a thickness of approx. 0.4 mm. To ensure that no pressure build-up can occur between the insulation and the two barriers, vertical evacuation slots 25 will be made in the walls of the two barriers, adjacent to the insulation. These slots will be gathered at the top and the bottom domes, where evacuation pipe outlets are arranged. Hence, any pressure build-up due to minor leaks of gas or water will be taken care of.

Figure 7:
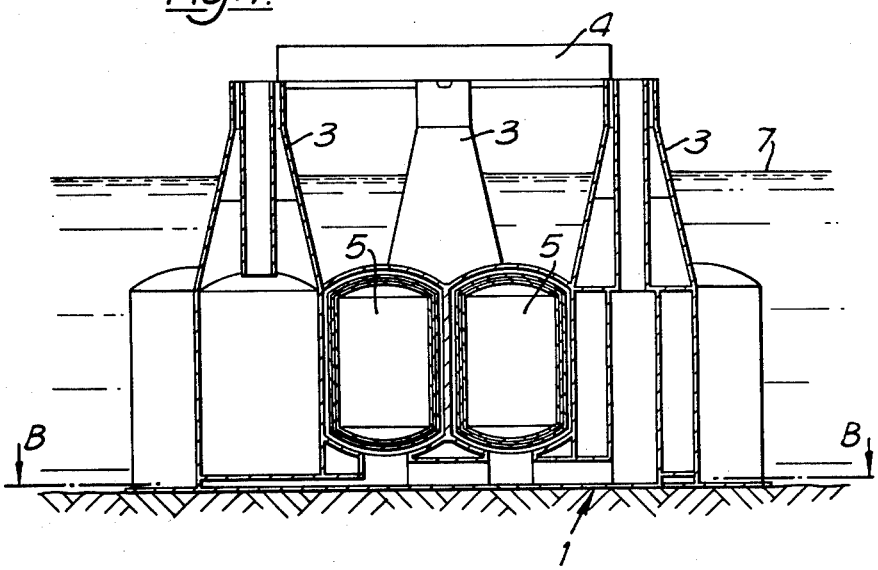
FIG. 7 shows schematically a vertical section through a semi-submersible terminal designed for storage of liquefied natural gas.
Figure 8:
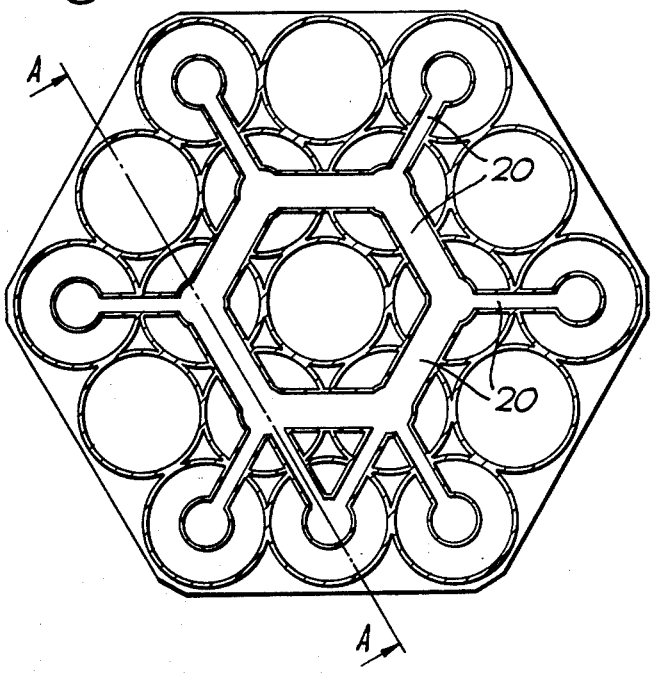
FIG. 8 shows a horizontal section along the line B—B on FIG. 7.

FIGS. 7 and 8 show schematically a vertical and a horizontal section respectively through a semi-submersible terminal designed for storage of liquefied natural gas. The terminal comprises a cellular base, nineteen cells arranged on the base, an upper structure projecting up from the base and up above the sea level and a deck superstructure supported above the sea level by said upper structure. The center cell forms as elongated central cylinder and is open in the bottom for riser connections. Twelve of the cells are intended for storage of LNG while the remaining six cells serve as ballast cells in order to enable the terminal to be trimmed and to control the draft during loading and unloading. Inside two of these shafts, an inner utility cylinder is located, one of which contains ballast pumps and pipings, while the other shaft houses LNG pipes and manifolds. Access from the utility cylinders to the supporting cylinder is possible through a tunnel system, similar to the previously described tunnel system for the gravity structure.

Figure 10:
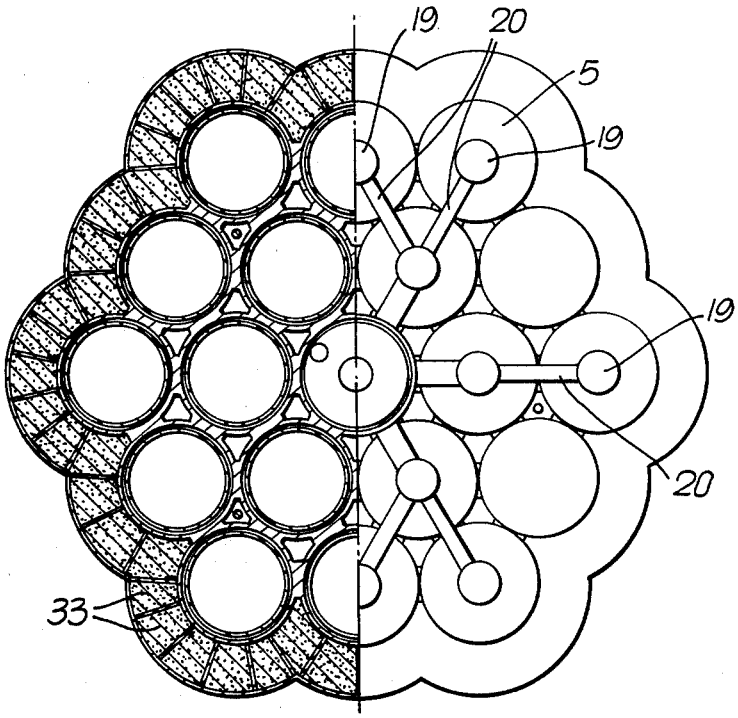
FIG. 10 shows a horizontal section along the line B—B of FIG. 9.
Figure 11:
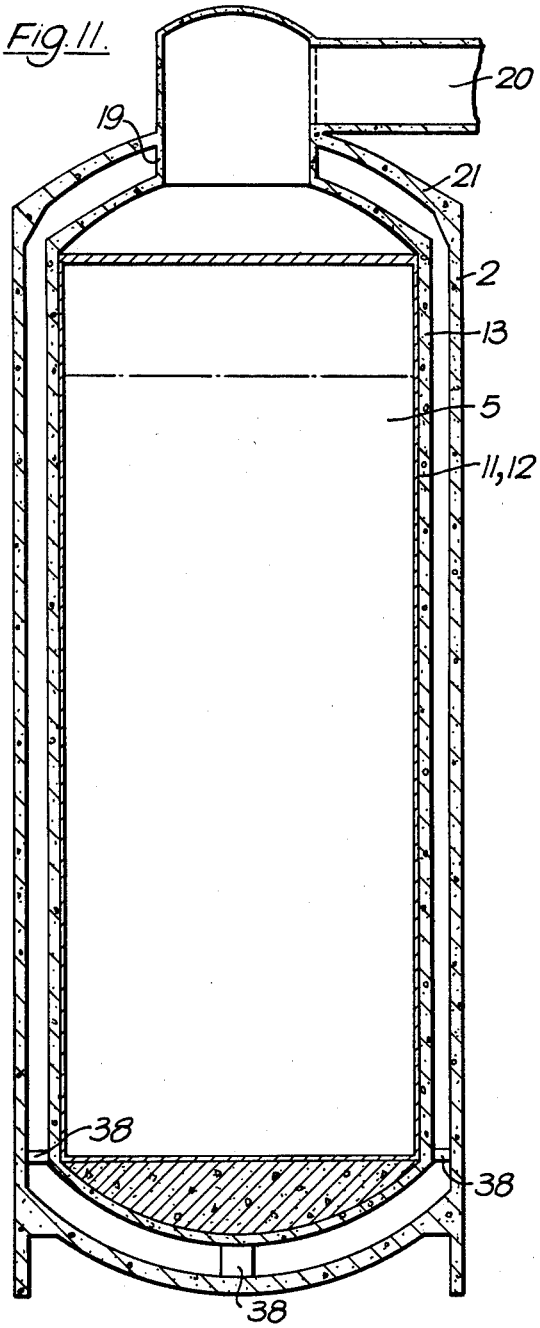
FIG. 11 shows a vertical section through an alternative embodiment of a structural cell housing a storage tank.

FIGS. 10 and 11 show a typical platform configuration suitable for a water depth of approximately 300–400 ft. The lower section of the structure consists of 19 cylindrical cells and the center cell is extended above sea level to form the monotower for support of the structural deck and the loading bridge.

Separate tanks for storage of approximately 260,000 $m^3$ of LNG are placed inside each of the 18 cylindrical cells of the submerged caisson. The storage tanks, which are structurally isolated from the caisson, are constructed in situ of prestressed and reinforced concrete. An insulated, liquefied gas containment system is attached to the inside of the cylindrical storage tanks.

One of the major differences between the embodiment shown on FIG. 1 and the embodiment on FIGS. 10 and 11 is the location of the access tunnel system. According to FIG. 1, the access tunnel system is incorporated into the base, while, according to the embodiment shown on FIG. 10, the access tunnels are located on top of the lower section. Another difference is that four of the cells are used as ballast cells. As shown on FIG. 10, the platform is equipped with a loading bridge. The tower 3 is divided into separate decks serving different purposes, cfr. FIG. 10, legend.

Figure 9:
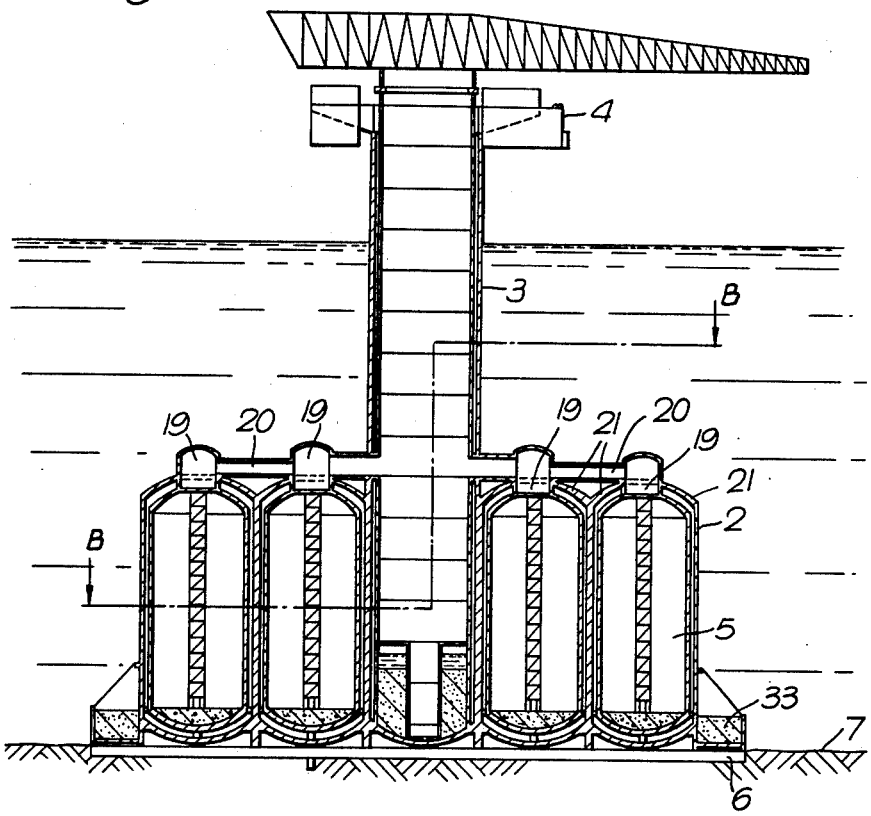
FIG. 9 shows schematically a vertical section through a second embodiment of a monotower gravity structure having the access tunnel on top of the lower section.

FIG. 11 shows a vertical section through one of the storage cells on FIG. 9. Contrary to the embodiment shown on FIG. 4, FIG. 11 shows a cell 2 having the access tunnel 20 at its top. Accordingly, the supporting shell sturcture 13 is supported at its upper end by a foundation cylinder 19. The supporting shell structure is further supported by supporting means 38. The cell has means at the top and bottom communicating with the sea to allow a convective flow of water through the cell 2 (not shown).

Figure 12:
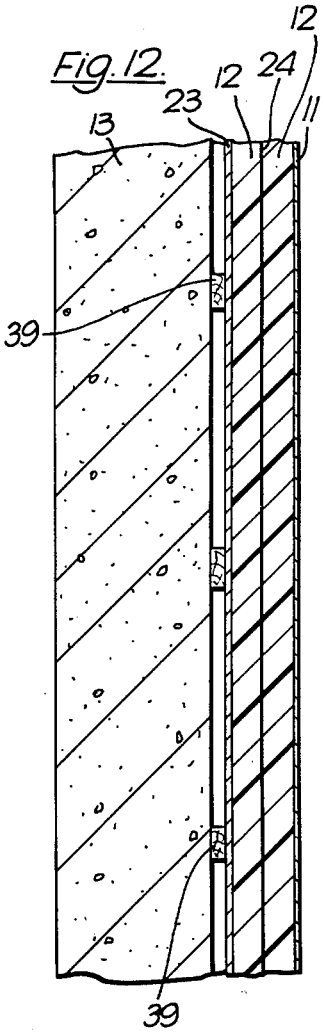
FIG. 12 shows in principle a horizontal section of a storage tank, giving details of a second embodiment of the insulation with a steel membrane as a primary barrier.

FIG. 12 shows in detail a section of the storage tank shown within the circle on FIG. 11. The storage tank consists of a primary barrier 11 for example made of stainless steel, insulation 12 and a secondary barrier 23, for example made of stainless steel. The insulation 12 may contain a fiberglass reinforcement 24, welded to the insulation. This unit (24, 23, 12, 11) is supported by the supporting shell structure 13 by means of wooden boxes 39.

In the previous sections, the present invention is described in connection with LNG. It should be noted, however, that the platform may be used for storing any type of cryogenic fluids. Further, the base of the platform may extend beyond the cells resting on the base, thereby forming a cantilevered section which may consist of open topped cells 33. These cells are preferably sandfilled, so as to produce sufficient weight to keep the platform on the sea bed even when the storage cells are emptied.

It should also be appreciated that any type of conventional insulation systems may be used without deviating from the inventive concept.

As described in connection with FIG. 4, each structural cell is equipped with openings in the upper dome and with a pipe 9 and valve 10 at the bottom, enabling the intended convective flow. It should be noted, however, that during towing out from the dry dock and optionally during towing out to the site, the valve 10 is closed, whereby the structural cells function as a buoyant body. The openings in the top domes may also be closed during these operations.

LNG loading/unloading may be performed by LNG tankers. Correspondingly, LNG can be loaded/unloaded through conventional risers and pipelines.

I claim:

1. An offshore structure for handling of cryogenic fluids, such as liquefied natural gas, comprising a lower section of concrete and an upper section projecting up from the lower section above the sea level to support a deck superstructure, the lower section being formed of a plurality of cells, at least one of said cells housing an insulated tank for storage of low temperature fluids, the insulated tank housed by said at least one cell being completely submerged in operation and being rigidly supported by said at least one cell, said storage tank also comprising at least a primary and secondary barrier with insulation associated therewith, and said offshore structure further comprising an access tunnel system providing communication between the storage tank and the deck superstructure.

2. An offshore structure as claimed in claim 1, wherein the storage tank is arranged in spaced relation to the corresponding cell in which the tank is housed such that the storage tank is separated from the walls of the cell, but supported by the cell, said cell including means providing communication with the surrounding sea to allow a water flow through the cell past the tank so as to produce a substantially constant temperature outside said tank.

3. An offshore structure as claimed in claim 1 or 2, wherein the storage tank is rigidly supported at the lower end thereof.

4. An offshore structure as claimed in claim 3, wherein the storage tanks are supported by ringformed concrete supports.

5. An offshore structure as claimed in claim 4, wherein said supports are made up of columns.

6. An offshore structure as claimed in claim 2, wherein the storage tank is suspended from the top of a cell.

7. An offshore structure as claimed in claim 1, wherein the access tunnel system is subjected to atmospheric conditions and houses pipe arrangements and accessory equipment.

8. An offshore structure as claimed in claim 1, wherein the lower section of the offshore sturucture is intended to rest on the sea bed.

* * * * *